US006679953B1

(12) United States Patent
Barnhart et al.

(10) Patent No.: US 6,679,953 B1
(45) Date of Patent: Jan. 20, 2004

(54) METHOD FOR ASSEMBLING AND HARDENING A BALL PLUG IN A COUNTERBORE OF A FUEL INJECTOR NOZZLE ASSEMBLY

(75) Inventors: Curt M. Barnhart, Indianapolis, IN (US); Gary A. Foreman, Indianapolis, IN (US); Dan N. Hamilton, Madison, IN (US); Cleo E. Willhite, Seymour, IN (US); Stephen C. Jackson, Commiskey, IN (US); Angelina Y. Cheung, Enfield, CT (US)

(73) Assignee: Cummins Engine Company, Inc., Columbus, IN (US)

( * ) Notice: Subject to any disclaimer, the term of this patent is extended or adjusted under 35 U.S.C. 154(b) by 0 days.

(21) Appl. No.: 10/180,680

(22) Filed: Jun. 26, 2002

(51) Int. Cl.[7] ..... C21D 1/18; C23C 8/26

(52) U.S. Cl. ..... 148/318; 148/328; 148/326; 148/579; 148/230; 239/584; 239/533.2

(58) Field of Search ..... 148/318, 328, 148/326, 579, 230; 239/584, 533.2

(56) References Cited

U.S. PATENT DOCUMENTS 3,641,802 A * 2/1972 Segro ..... 239/449
6,286,769 B1 * 9/2001 Gunji et al. ..... 239/585.1

FOREIGN PATENT DOCUMENTS

JP 408074707 * 3/1996 ..... F02M/61/18

* cited by examiner

*Primary Examiner*—Deborah Yee
(74) *Attorney, Agent, or Firm*—Woodard, Emhardt, Moriarty, McNett & Henry LLP

(57) ABSTRACT

According to the method of the present invention, the ball plug is press fit into the counterbored passage of a fuel injector nozzle assembly prior to hardening of the fuel injector nozzle assembly. A core hardening and gas nitriding process is then applied to the assembly, causing the ball plug to expand and the passage diameter to shrink. This results in a greatly increased seal between the ball plug and the passage, and substantial elimination of the gaps experienced therebetween in prior art fuel injector nozzle assemblies.

7 Claims, 4 Drawing Sheets

METHOD FOR ASSEMBLING AND HARDENING A BALL PLUG IN A COUNTERBORE OF A FUEL INJECTOR NOZZLE ASSEMBLY

TECHNICAL FIELD OF THE INVENTION

The present invention generally relates to fuel injector assemblies and, more particularly, to a method for assembling and hardening a ball plug in a counterbore of a fuel injector nozzle assembly.

BACKGROUND OF INVENTION

As is known in the art, the nozzle assemblies of fuel injectors contain drilled passages that must be plugged after machining. FIG. 1 illustrates a cross-section of one such prior art counterbored passage 10 formed into the body 12 of a fuel injector nozzle 14. The body 12 is made, for example, from H13 steel and is hardened (for example, core hardened and gas nitrided by means of processes well-known in the art). The core hardening and gas nitriding process infiltrates the crystalline structure of the steel body 12 to an average depth, as can clearly be seen in the areas 16.

After the core hardening and gas nitriding process is performed, a ball plug 18 is press fit into the counterbored passage 10. The ball plug 18 may be made, for example, from annealed 52100 steel. The press-fitting operation employs enough force to squeeze the distal end of the ball plug 18 into the reduced diameter section of the passage 10 counterbore, causing tearing of the ball plug 18 material in the process. This results in the distal end of the ball plug 18 not forming a tight seal with the walls of the passage 10, as can be seen at the gaps 20.

During operation of the fuel injector nozzle 14, the passage 10 is filled with fuel, which reaches a relatively high pressure (25 ksi or 375 lbf, for this prior art injector) during an injection event. The existence of the gaps 20 significantly increases the surface area upon which this pressure acts, resulting in an unacceptable failure rate of ball plugs 18 being forced out of the passage 10.

There is therefore a need for a method for assembling and heat treating a ball plug in a counterbore of a fuel injector nozzle assembly which significantly increases the pressure required to force the ball plug 18 out of the passage 10. The present invention is directed toward meeting this need.

SUMMARY OF THE INVENTION

According to the method of the present invention, the ball plug is press fit into the counterbored passage of a fuel injector nozzle assembly prior to hardening of the fuel injector nozzle assembly. A core hardening and gas nitriding process is then applied to the assembly, causing the ball plug to expand and the passage diameter to shrink. This results in a greatly increased seal between the ball plug and the passage, and substantial elimination of the gaps experienced therebetween in prior art fuel injector nozzle assemblies.

DETAILED DESCRIPTION OF THE PREFERRED EMBODIMENTS

Figure 1:
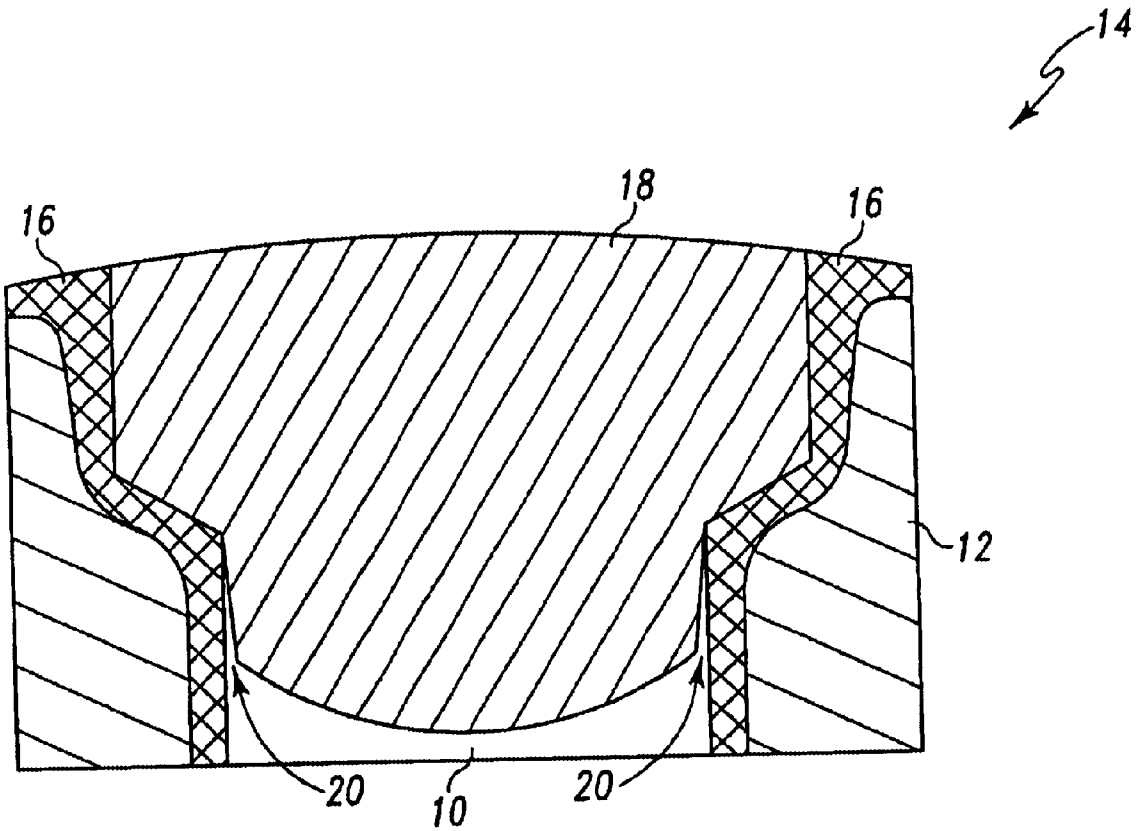
Fig. 1 (Prior Art)
FIG. 1 is a cross-sectional view of a prior art fuel injector nozzle assembly.

For the purposes of promoting an understanding of the principles of the invention, reference will now be made to the embodiment illustrated in the drawings and specific language will be used to describe the same. It will nevertheless be understood that no limitation of the scope of the invention is thereby intended, and alterations and modifications in the illustrated device, and further applications of the principles of the invention as illustrated therein are herein contemplated as would normally occur to one skilled in the art to which the invention relates.

Figure 2:
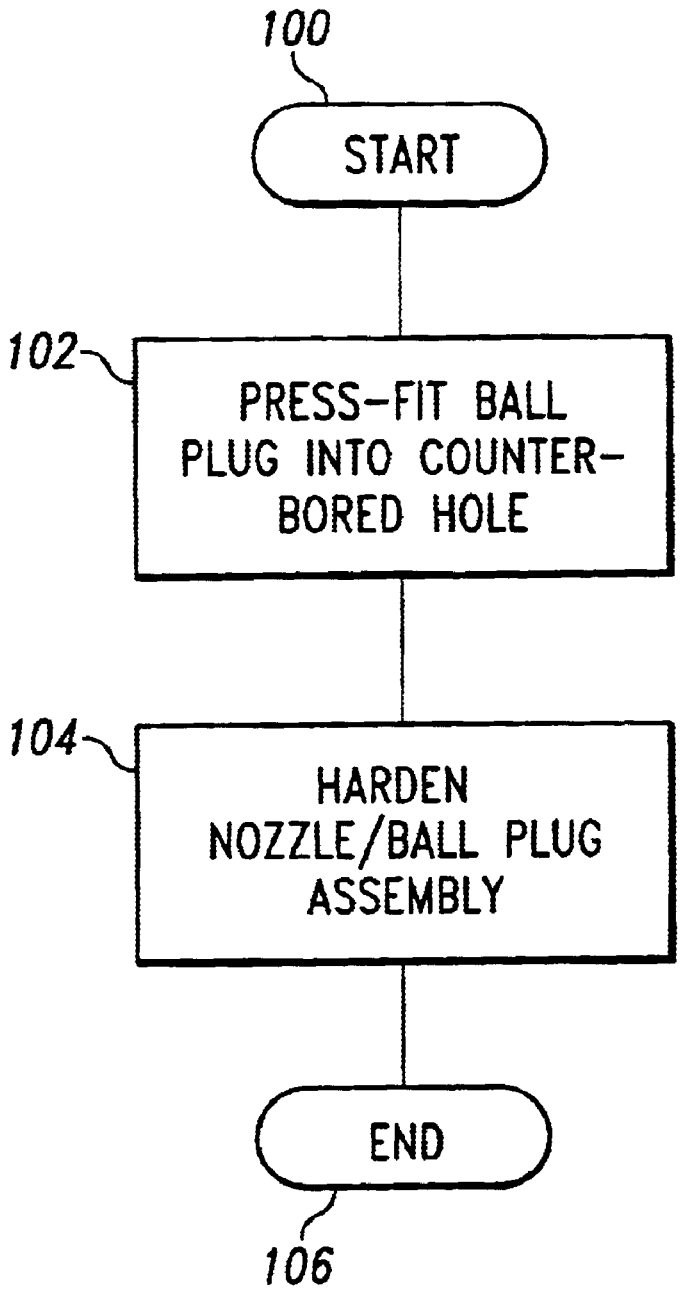
FIG. 2 is a schematic process flow diagram of a preferred embodiment method of the present invention.

The present invention provides a method for assembling and heat treating a ball plug in a counterbore of a fuel injector nozzle assembly which results in a much lower failure rate of ball plugs being forced from their counterbores by the internal pressure of the fuel injector nozzle assembly. With reference to FIG. 2, a preferred embodiment process of the present invention is schematically illustrated. The process starts at step 100 and continues at step 102 where the ball plug is press fit into the counterbored hole of the fuel injector nozzle. The shapes and materials of the ball plug and the counterbored hole of the fuel injector nozzle are the same as those used in the prior art device. Step 102 is performed before either the ball plug 18 or the fuel injector nozzle 12 are hardened. By press fitting the ball plug into the counterbored hole prior to hardening, tearing of the ball plug material is minimized because the counterbore material is softer and has a hardness which is more closely matched to the hardness of the ball plug material.

At step 104, the combined fuel injector nozzle/ball plug assembly is hardened using any desired process, such as the core hardening and gas nitriding process used in the prior art device of FIG. 1. The process then ends at step 106.

Figure 3:
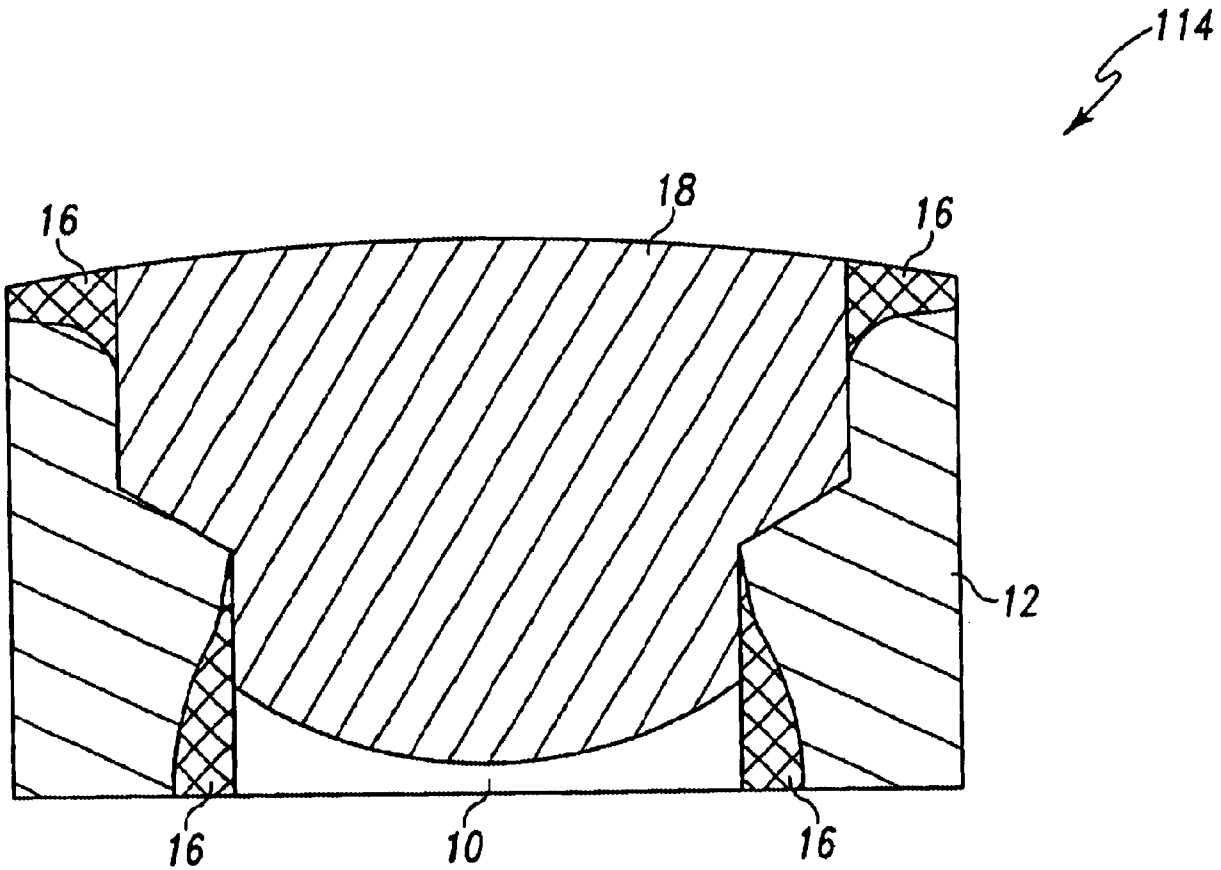
FIG. 3 is a cross-sectional view of a fuel injector nozzle assembly constructed according to the method of the present invention.

The fuel injector nozzle assembly formed according to the method of the present invention is illustrated schematically in cross section in FIG. 3. The nozzle assembly is generally designated as 114. As can be seen, the core hardening and gas nitriding process has infiltrated the crystalline structure of the steel body 12 in the areas 16 only where the process was able to penetrate the material from exterior to the ball plug 18 location. Because the ball plug 18 is press fit into the nozzle 12 prior to this heat treating process, tearing of the ball plug 18 material was minimized and the gaps 20 between the ball plug 18 and the sides of the counterbore 10 (see prior art FIG. 1) are not present in the nozzle assembly 114 formed by the method of the present invention. Because of the absence of the gaps 20, the surface area upon which the pressure within the fuel injector may operate is greatly reduced, thereby greatly reducing the force that the pressurized fuel may exert upon the ball plug 18 in a direction which would tend to force the ball plug 18 out of the counterbore 10.

The seal between the ball plug 18 and the nozzle 12 is further strengthened in the process of the present invention by the fact that during the core hardening and gas nitriding process, the matrix of the ball plug 18 material expands, causing the volume of the ball plug 18 to increase. Additionally, the matrix of the nozzle 12 material is also increasing, causing the counterbore diameter to decrease. The resultant increase in press fit of the ball plug after hardening causes the mean static load-to-failure of the ball plug 18 to increase approximately 50% over the prior art ball plug press fit method.

Figure 4:
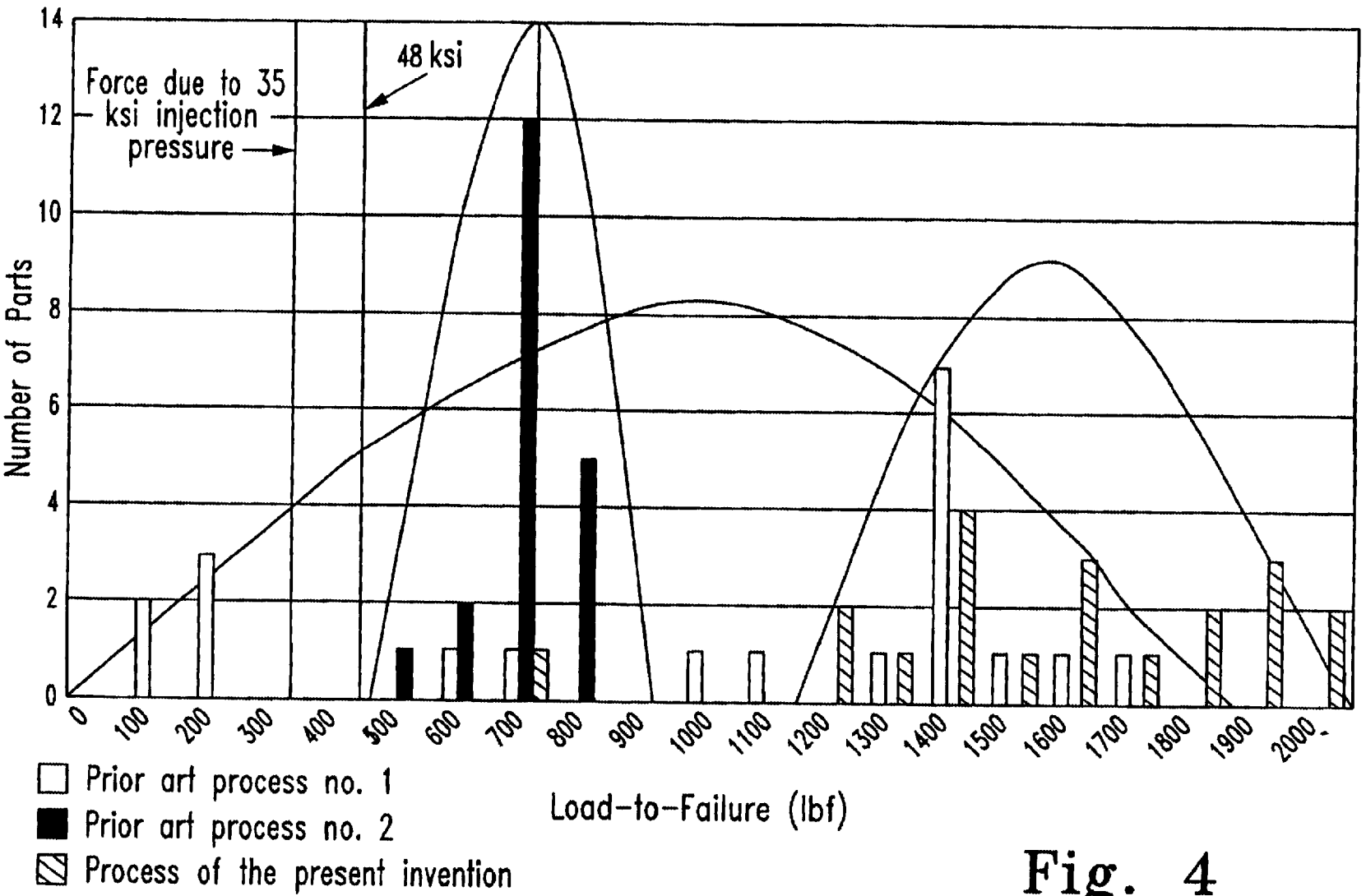
FIG. 4 is a histogram showing the load-to-failure results for a plurality of parts constructed according to two different prior art methods and according to the method of the present invention.

This increase in the effectiveness of the ball plug press fit with the present invention can be seen with reference to FIG. 4. FIG. 4 is a histogram showing the test results of a number of fuel injectors in which the pressure needed to unseat the ball plug from the injector nozzle was measured. Two prior art processes similar to that disclosed above have been graphed. In the prior art process number 1, the mean load-to-failure is just over 1,000 lbf. In the prior art process number 2, the load-to-failure pressures were much more tightly grouped, however the mean value dropped to approximately 750 lbf. For the group of injectors formed according to the method of the present invention, the average load-to-failure force was approximately 1,600 lbf, an improvement of 60% over process 1 and 113% over process 2. As will be appreciated by those having ordinary skill in the art, a significant increase in load-to-failure figures was obtained by using the method of the present invention.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

What is claimed is:

1. A method of assembling a ball plug in a counterbore of a fuel injector nozzle assembly, comprising the steps of:

a) press-fitting the ball plug into the counterbore; and b) hardening the ball plug/fuel injector nozzle assembly after completing step (a).

2. The method of claim 1, wherein step (b) comprises heat treating the ball plug/fuel injector nozzle assembly.

3. The method of claim 1, wherein step (b) comprises core hardening and gas nitriding the ball plug/fuel injector nozzle assembly.

4. The method of claim 1, wherein the ball plug is formed from 52100 steel.

5. The method of claim 4, wherein the ball plug is formed from annealed 52100 steel.

6. The method of claim 1, wherein the fuel injector nozzle assembly is formed from H13 steel.

7. A ball plug/fuel injector nozzle assembly formed according to the method of claim 1.

* * * * *